United States Patent [19]

Piorkowski

[11] 3,958,758

[45] May 25, 1976

[54] SPRAYING APPARATUS

[75] Inventor: Joseph Piorkowski, Toledo, Ohio

[73] Assignee: Owens-Illinois, Inc., Toledo, Ohio

[22] Filed: May 27, 1975

[21] Appl. No.: 580,656

[52] U.S. Cl. ..... 239/133; 118/302; 239/419.5; 239/427.5; 427/422

[51] Int. Cl.[2] ..... B05B 7/16

[58] Field of Search ..... 239/128, 102, 133, 85, 239/423, 424, 419.5, 419.3, 419, 427.3, 427.5; 427/422; 118/302, 308

[56] References Cited

UNITED STATES PATENTS

| | | | |
|---|---|---|---|
| 2,929,436 | 3/1960 | Hampshire | 118/308 X |
| 3,715,076 | 2/1973 | Kenderi | 239/133 |

*Primary Examiner*—John J. Love
*Assistant Examiner*—Michael Mar
*Attorney, Agent, or Firm*—Steve M. McLary; Edward J. Holler

[57] ABSTRACT

Apparatus for spraying powdered materials. A spray gun for applying hot powdered thermoplastic materials to a substrate to be coated may be constructed in such a fashion as to have no moving parts. A first fluid amplifier section inspirates the powdered material and cool air from the outside atmosphere. A second fluid amplifier section also inspirates outside air. This air is heated as it is inspirated. A transition section connects the two fluid amplifier sections. The powdered material inspirated by the first fluid amplifier section mixes with the heated air inspirated by the second fluid amplifier section. This causes partial melting of the powdered material so that as it exits from the second fluid amplifier toward the substrate to be coated, the material is in a condition to allow more uniform coating of the substrate.

7 Claims, 1 Drawing Figure

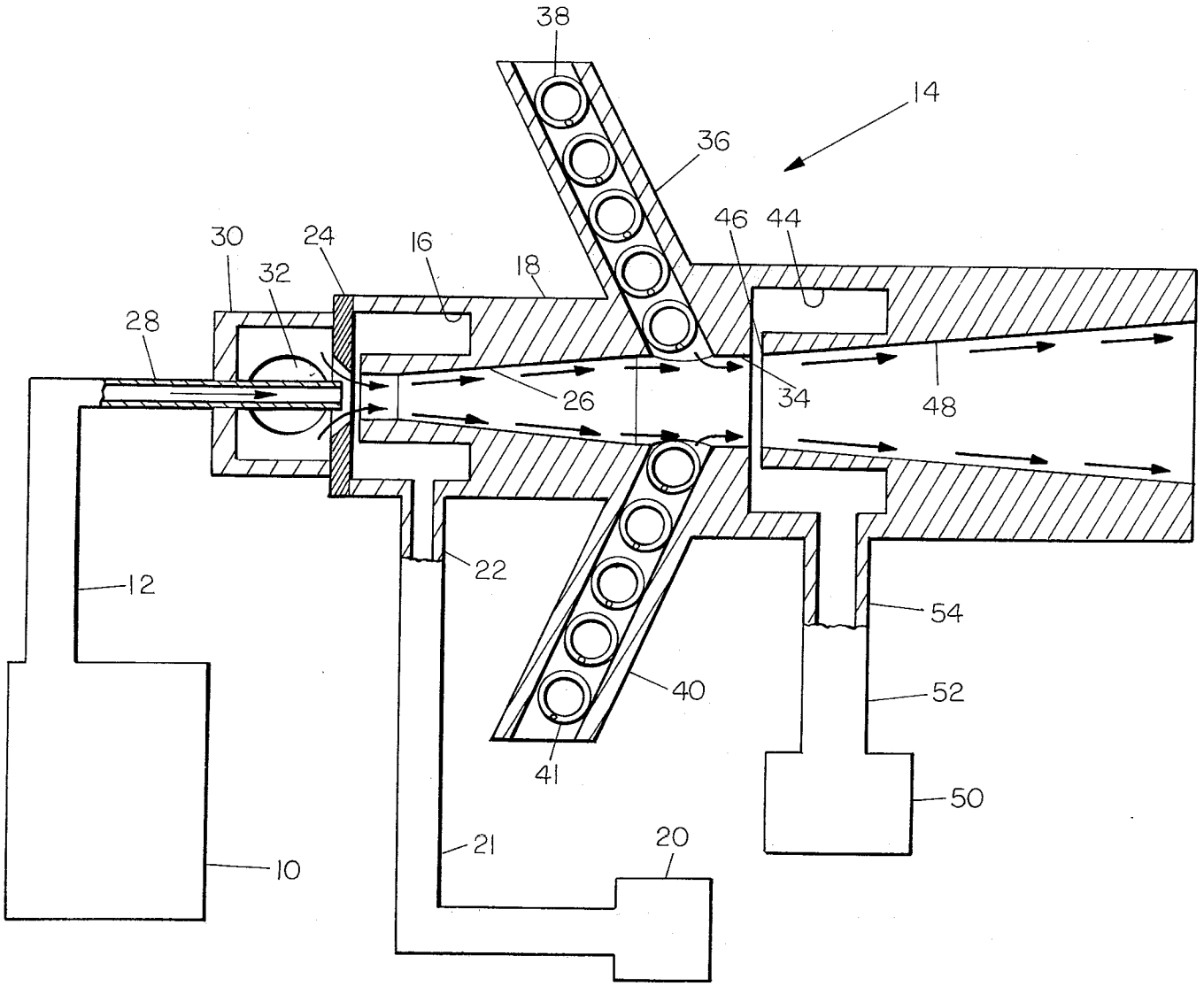
14
48
54
52
50
44
34
46
36
40
20
38
26
41
18
22
21
16
24
32
10
30
28
12

SPRAYING APPARATUS

BACKGROUND OF THE INVENTION

This invention generally relates to coating of a substrate with a powdered, thermoplastic material. More particularly, this invention relates to such coating wherein the powdered material is heated as it is applied to the substrate. Specifically, this invention relates to a spraying apparatus having no moving parts but rather using two series connected fluid amplifiers and an inlet air heater section to supply heated, powdered material to the substrate.

It has long been known that spraying heated thermoplastic materials onto a surface to be coated is a desirable coating technique. Such a system allows quite uniform coating thickness and very good flow out characteristics. However, conventional spray guns which use needles to shut off or control the material flow through them have not been completely successful. In addition, the heating of the powdered material prior to its application has also presented problems since the material once heated tends to stick to the interior of this application apparatus. I have solved these problems by using two fluid amplifiers connected in series to first inspirate the powdered material and cool outside air, and then move outside air which is heated as it is inspirated. The result of this arrangement is that the inlet for the powdered material is remote from the heating location and the heated powdered material tends to flow in a form of air pipe and does not touch the walls of the apparatus.

SUMMARY OF THE INVENTION

My invention is an apparatus for spraying heated, powdered material onto a substrate to be coated with such powdered material. The apparatus includes a first fluid amplifier section. A cool air inlet section is connected to the first fluid amplifier section for furnishing an amplified flow of air. A source of the powdered material is connected to the first fluid amplifier section. Also provided is a second fluid amplifier section. A transition section connects the first and second fluid amplifier sections. At least one heated air inlet section is provided in communication with the transition section adjacent to the inlet to the second fluid amplifier section. Means are positioned in the heated air inlet section for heating the air which passes therethrough. A source of air under pressure is connected to both the first and second fluid amplifier sections.

BRIEF DESCRIPTION OF THE DRAWING

The single drawing FIGURE is a cross-sectional view taken along the longitudinal axis of the apparatus of the present invention.

DETAILED DESCRIPTION OF THE DRAWING

The drawing figure illustrates a cross-sectional view of the present invention. The present invention is designed as an apparatus for spraying powder-like materials, such as thermoplastics, in a hot configuration. That is, the powdered material is heated as it is sprayed onto a substrate to implement rapid fusion and curing onto the substrate itself. The material to be sprayed is furnished from a reservoir 10 through an inlet pipeline 12 to a spray gun 14 of the present invention. The spray gun 14 will inspirate any powdered-type material held in the reservoir 10, but to aid the entrainment of this material, it is possible to pressurize the reservoir slightly with an inert gas such as nitrogen. This will maintain a flow of material through the inlet pipeline 12 and additionally will maintain the material within the reservoir 10 in a stirred or somewhat fluid condition so that it may flow more readily when required into the spray gun 14. The actual flow through the spray gun 14 is initiated by a first fluid amplifier section which is defined in part by an annular chamber 16 formed in a body section 18. The annular chamber 16 is connected to a source of compressed air 20 by a pipeline 21 which is connected to an inlet pipe 22 to the annular chamber 16. By way of specific example, the compressed air furnished to the annular chamber 16 may be at a pressure of 20 lbs. per square inch and at a flow rate of 3 cubic feet per hour. The fluid amplifier is further defined by a back plate 24 which is positioned closely adjacent to the open end of the annular chamber 16. The leading or forward edge of the back plate 24 is positioned a distance approximately 1/1000 of an inch plus or minus 3/10,000 of an inch away from the edge of the annular chamber 16. Note that this opening is grossly exaggerated in the drawing figure to allow understanding the flow patterns involved in the spray gun 14. Thus, the compressed air which enters the annular chamber 16 through the inlet pipe 22 exits through this relatively narrow slot or opening. The air then travels along a nozzle section 26 expanding as it moves. A thin sheet of air attaches itself to the interior contours of the nozzle section 26. It may be seen that the nozzle section 26 is of the diverging type and, by way of example, the diameter at the point at which the air is introduced from the annular chamber 16 may be approximately 1/25 of an inch while the largest diameter of the nozzle section 26 may be approximately 5/16 of an inch. At the inlet to the nozzle section 26 an intense suction or low pressure area is created as a result of the throttling of the flow between the back plate 24 and the edge of the annular chamber 16. This results in the powder material being drawn from the reservoir 10 through the inlet pipeline 12 and through a tube 28 connencted to the pipeline 12 whose end is positioned adjacent to the back plate 24. The suction created by the air flow through the nozzle section 26 tends to pull the powdered material through the inlet tube 28 and this material is then entrained in the air flow proceeding through the nozzle section 26. Additionally, a cool air inlet section 30 is attached to the backside of the back plate 24 and defines a chamber through which outside air may be inspirated. The cool air inlet section 30 has formed in its side at least one opening 32 to the outside atmosphere through which outside air is introduced. By way of example, the diameter of the opening 32 may be approximately 25/32 of an inch. With the diameter of the opening 32 and the space between the back plate 24 and the annular chamber 16 as described, the amplification factor present is approximately 140 to 1. That is, for each cubic foot of air introduced into the annular chamber 16, 140 cubic feet of air will flow in through the opening 32 and enter the nozzle section 26. This general type of fluid amplifier is not unknown in the art, and a similar device is sold by the Vortec Corporation, 4511 Reading Road, Cincinnati, Ohio 45229. However, those units sold by the Vortec Corporation are said to have amplification ratios in the ramp of forty to one. However, I have found that with the configuration described the amplification ratio is easily attainable at one hundred and forty to one and under some circumstances may rise to be as high as two hundred to one.

The nozzle section 26 smoothly merges into a transition section 34 whose outlet diameter is approximately ¾ of an inch. Communicating with the transition section 34 and the outside atmosphere is at least one heated air inlet section 36. Contained within the heated air inlet section is a heating means 28 which may be an electrical heating unit having multiple coils. The inside diameter of the heated air inlet section 36 through which outside air may flow may be made approximately 1⅜ inches in diameter. If necessary, there may be a second heated air inlet section 40 which also contains a heating means 41 which may be identical to the heating means 38. As the air flow passes through the transition section 34, it will tend to inspirate air through the two heated air inlet sections 36 and 40. Additionally, a second fluid amplification section is provided which includes a second annular chamber 44 which has a relatively small opening 46 into a second nozzle section 48. The opening 44 is preferably held at a dimension of approximately 25/10,000 of an inch plus or minus 3/10,000 of an inch. The nozzle section 48 smoothly merges with the transition section 34 with its diameter increasing from approximately ¾ of an inch at the merge point to a final opening dimension of approximately 1⅛ inches in diameter. The second annular chamber 44 is supplied with compressed air under pressure from a source of compressed air 50 and a pipeline 52 which carries the compressed air. The pipeline 52 is connected to an inlet line 54 which is in communication with the second annular chamber 44. In the case of this fluid amplification section, the compressed air is preferably furnished at a pressure of approximately 40 pounds per square inch and at a flow rate of approximately 30 cubic feet per hour. It would be possible to use the air source 20, but for finer control, a separate source 50 may be used; or pressure regulation means may be interposed in common feed lines to allow the supply of air at different pressures to the different fluid amplifiers. The basic amplification factor is again approximately 140 to one so that the air which is pulled in through the heated air inlet sections 36 and 40 is approximately 140 times 30 cubic feet per hour. An intense suction is created by the exit of the air from the annular chamber 44 through the small opening 46. This suction pulls the outside air in through the two heated air inlet sections 36 and 40. Additionally, as was previously pointed out, more air is introduced as a result of a flow of air through the transition section 34. The heating means 38 and 41 cause the air which is introduced through these two sections to be heated to an appreciable temperature level. The purpose behind this is to partially melt the plastic material which had been introduced through the inlet tube 28 and prepare it for deposition upon a substrate.

There is a stream of air which is entrained along the wall of both the first nozzle section 26 and the second nozzle section 48 as a result of the air exiting through the small gaps. This air flow along the nozzle walls, particularly with respect to nozzle section 48, prevents the heated plastic particles from touching the wall of the nozzle section 48 and depositing themselves thereon. Rather, there is an intense mixing and flow of the heated air and the plastic particles down the center of the nozzle section 48. This heated and partially molten plastic then exits from the outlet of the nozzle section 48 and is deposited upon a substrate which is to be coated. Thus, the spray gun 14 of the present invention provides a relatively simple yet effective method of powder spraying various plastic materials and presenting these materials to a substrate which is to be coated in a molten condition that promotes rapid flow out and even coating of the substrate. In addition, the spray gun 14 has no moving parts whatsoever and as such is extremely simple to maintain and very reliable in operation.

What I claim is:

1. An apparatus for spraying heated, powdered material onto a substrate to be coated with said powdered material which comprises, in combination:

a first fluid amplifier section;

a cool air inlet section connected to said first fluid amplifier section for furnishing an amplified flow of air;

a source of said powdered material connected to said first fluid amplifier section;

a second fluid amplifier section;

a transition section connecting said first and said second fluid amplifier sections;

at least one heated air inlet section in communication with said transition section adjacent to said second fluid amplifier section;

means, positioned in said heated air inlet section, for heating air which passes therethrough; and a source of air under pressure connected to both said first and said second fluid amplifier sections.

2. The apparatus of claim 1 wherein said first fluid amplifier section comprises:

a main body member;

a first diverging nozzle section formed substantially longitudinally in said main body member;

an annular chamber formed in said main body member and having a circumferential slot in communication within the smaller end of said first diverging nozzle section, said source of air under pressure being connected to said annular chamber; and a back plate, positioned to seal said annular chamber and define a gap of no more than one-thousandths of an inch for said slot.

3. The apparatus of claim 2 wherein said cool air inlet section is defined by an enclosed chamber with one wall thereof being said back plate and having said smaller end of said first diverging nozzle section opening into said enclosed chamber, said enclosed chamber also including an opening in one wall thereof in communication with the outside atmosphere.

4. The apparatus of claim 3 which further includes a tube, connected to said source of powdered material, extending through said enclosed chamber and terminating adjacent said smaller end of said first diverging nozzle section.

5. The apparatus of claim 2 wherein said transition section smoothly merges with the larger end of said first diverging nozzle section and wherein said second fluid amplifier section comprises:

a second diverging nozzle section, formed substantially longitudinally in said main body member, having its smaller end smoothly merging with said transition section and its larger end opening to the outside atmosphere; and a second annular chamber, formed in said main body member, having a circumferential slot formed therein to bring said annular chamber into communication with the smaller end of said second diverging nozzle section, said source of air under pressure being connected to said second annular chamber.

6. The apparatus of claim 5 wherein said slot in said second annular chamber is no greater than twentyfive-ten-thousandths of an inch in width.

7. The apparatus of claim 5 wherein a portion of the air exiting from said slot in said second annular chamber flows along the surface of said second diverging nozzle section thereby preventing contact of heated air and said powdered material with said second diverging nozzle section.

* * * * *